United States Patent [19]

Davis

[11] 4,119,816

[45] Oct. 10, 1978

[54] CROSS CONNECT PANEL HAVING SLIDE SWITCHES AND BUS BAR CONSTRUCTION

[75] Inventor: Robert E. Davis, Salt Lake City, Utah

[73] Assignee: Stage-Brite Inc., Minneapolis, Minn.

[21] Appl. No.: 746,719

[22] Filed: Dec. 2, 1976

[51] Int. Cl.[2] ..... H01H 9/00

[52] U.S. Cl. ..... 200/1 R; 200/16 C; 361/350; 361/355; 361/425

[58] Field of Search ..... 200/1 R, 5 R, 16 R, 200/16 C, 16 D, 17 R, 248, 291, 153 K, 153 G; 361/341, 350, 353, 355, 425

[56] References Cited

U.S. PATENT DOCUMENTS

| | | | |
|---|---|---|---|
| Re. 28,134 | 8/1974 | Davis | 200/1 R |
| 2,796,473 | 6/1957 | Davis | 200/16 C |
| 2,990,460 | 6/1961 | Worth et al. | 200/33 R |
| 3,205,319 | 9/1965 | Anderson et al. | 200/16 C |
| 3,231,784 | 1/1966 | Major | 315/312 |
| 3,467,922 | 9/1969 | Greenwall et al. | 335/161 |
| 3,496,421 | 2/1971 | Greenwall, Jr. | 361/353 |
| 3,502,824 | 3/1971 | Bonacquisti | 200/16 D |
| 3,555,212 | 1/1971 | Cherry | 200/17 R |
| 3,603,747 | 9/1971 | Davis | 200/1 R |
| 3,614,346 | 10/1971 | Gudaitis | 200/16 D |
| 3,632,909 | 1/1972 | Rowley | 200/16 D |
| 3,652,813 | 3/1972 | Davis | 361/425 X |
| 3,670,117 | 6/1972 | Yancey | 200/16 C |
| 3,737,594 | 6/1973 | Rosmanith | 200/16 R |
| 3,796,845 | 3/1974 | Shirae | 200/17 R |
| 3,800,107 | 3/1974 | Heide | 200/16 D |
| 4,041,257 | 8/1977 | Yancey | 200/16 R X |

*Primary Examiner*—James R. Scott

*Attorney, Agent, or Firm*—Merchant, Gould, Smith, Edell, Welter & Schmidt

[57] ABSTRACT

A cross connect panel having a switchable slider assembly for positive engagement and disengagement of the loads to the supply buses. A resilient detent mechanism is provided for positive indexing of the slider assembly in alignment position with the various supply buses. The parallel supply buses are held in place by a system of bus holders and interlocking spacers and the bus bar assembly is held together by bolts through the interlocking spacers, thereby avoiding the necessity of drilling bolt holes in the bus bars and providing proper insulation therefor.

5 Claims, 6 Drawing Figures

CROSS CONNECT PANEL HAVING SLIDE SWITCHES AND BUS BAR CONSTRUCTION

BACKGROUND OF THE INVENTION

The present invention pertains to improvements in cross connect panels, and in particular to the type of cross connect panels adapted for controlling lighting installations, for example stage lighting in a theater.

In a typical installation it is necessary to provide some means for interconnection between a plurality of variable power dimmer controls on the one hand, and a plurality of lamps or sets of lamps whose intensity is to be controlled, on the other hand. Because different stage productions require different types of lighting control, it is generally considered necessary that the system be readily programmable so that any particular set of lights can be controlled by any given dimmer, as may be required for a particular stage production. This requirement for maximum flexibility has generally precluded permanent or semi-permanent interconnections whereby each dimmer control would be dedicated to a given set of lights. Accordingly, cross connect panels have been provided to supply the necessary interconnection flexibility.

Cross connect panels generally comprise a matrix of buses or rails, with a first set of parallel buses in one plane, and a second set of parallel buses at right angles to the first set and spaced a short distance from them so that there is normally no electrical contact between two sets of buses. A plurality of sliders are provided, usually one for each of the buses in one of the sets of buses. The sliders contain contacts for making an electrical circuit between the bus on which the slider is mounted, and any of the buses perpendicular thereto, depending upon the positioning of the slider. Any of the loads can be connected to any of the dimmers simply by proper positioning of the sliders.

Although prior art cross connect panels have met with success, they have been subject to a number of problems which have tended to limit their performance and increase their cost. Because of the very high amperages involved, the slider mechanism which actually makes the interconnections must be very carefully designed to make positive and secure electrical contact so as to prevent arcing between the slider contacts and the buses. At the same time, means should be provided to insure that a number of unwanted circuit connections are not momentarily made when the slider is being moved from one position to another. Although prior art bus bars are recessed in channels between protruding insulators for spark suppression, still it is all too possible for the contact of prior art sliders to bounce across the protruding insulators and hit every bus bar during a change of position of the slider.

Another problem with prior art cross connect sliders is the uncertainty of positioning when an operator is moving the slider to a new position. Because of the close spacing of the buses, it is often necessary in prior art devices for the operator to adjust the final position by "feel" which of course creates the possibility of further arcing, or inadvertent connection to the wrong bus.

Because of the high currents involved, it is generally necessary to construct the conductors from elongated metal bars of substantial thickness. A sandwich structure is often made with alternating layers of insulating pieces and bus bars. The problem then becomes one of how to hold the sandwich together. Problems exist in some prior art devices because insufficient pressure has been used to hold the stack together, with the result that inadvertent downward pressure applied to a slider might bow or bend a bus bar out of line, or split them apart, wedging the slider contact. Another method of holding the bus bar/insulator stack together involves drilling holes through each piece so that they can be bolted together. Although this method yields a workable structure, it leads to extra expense in drilling of the bus bars, and providing insulating grommets for each one to prevent them from shorting out on the bolt. Also, since the holes drilled out from the bus bar reduce its current carrying capability by drastically reducing the effective cross sectional area at the hole, it has generally been necessary to provide very thick or wide bus bars to compensate, leading to further great expense.

To overcome these and other problems existing in the prior art, the present invention provides an improved cross connect panel.

SUMMARY OF THE INVENTION

The present invention provides a cross connect panel having an improved bus bar insulating and supporting assembly, and having a switchable cross connect slider for positive engagement and disengagement of loads. According to the present invention, there is provided a plurality of elongated bus bars and means supporting said bus bars in mutually insulated spaced parallel relationship. The support means comprises first insulating members coextensive with and grooved to receive the bus bars, and second insulating members interlocking said first insulating members. Clamping means, which may comprise clamping bolts passing through the second insulating members, serve to clamp the assembly together.

Means are provided for positioning and supporting a plurality of conducting rails in parallel relationship to each other, generally perpendicular to the bus bars and spaced apart therefrom. Slider assemblies are slideably positioned on said rails for movement therealong for selective alignment with and connection to individual bus bars. The slider assemblies include switching means for positive connection and disconnection of electrical paths between the bus bars and the rails.

DESCRIPTION OF THE PREFERRED EMBODIMENT

Figure 1:
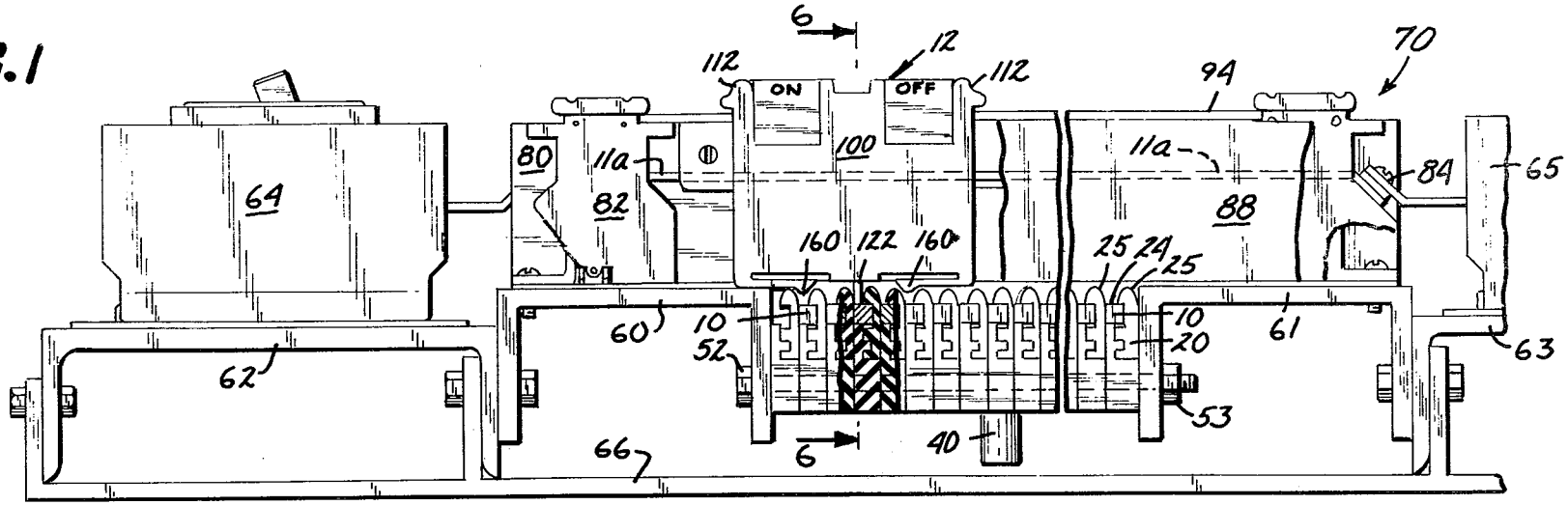
FIG. 1 is a side view in elevation of a cross connect panel assembly according to the present invention, portions thereof broken away and shown in section.

The cross connect panel assembly of FIG. 1 generally comprises a plurality of parallel bus bars 10 perpendicular to the plane of the drawing, and a plurality of parallel slider rails 11 oriented perpendicular to the bus bars 10. In FIG. 1, only one slider rail 11 and its associated supporting structure is visible, it being understood that the other slider rails, as many as desired, are positioned beside and behind the one visible in FIG. 1. A cross connect slider, generally designated by reference numeral 12, is positioned for movement to the left and right in FIG. 1 whereby to connect slider rail 11 with any of the bus bars 10, as will be explained hereinafter.

Figure 2:
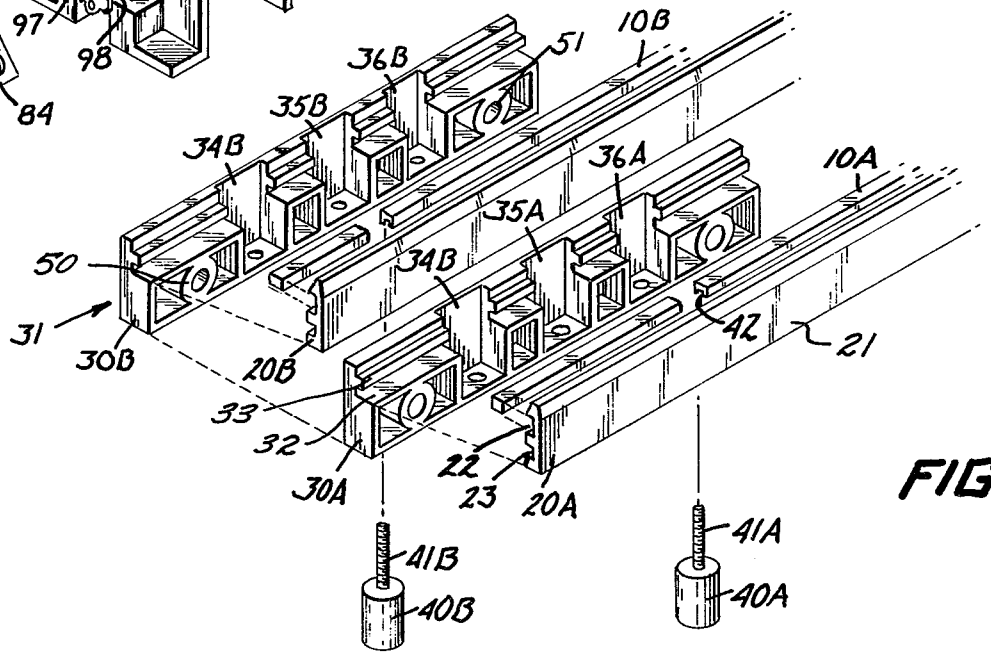
FIG. 2 is a fragmentary exploded view in perspective of the bus bar and interlocking spacer assembly of the panel of FIG. 1.

As shown in FIGS. 1 and 2, the bus bars are held in place by a system of insulating holders and interlocking spacers. In the exploded view of FIG. 2, a pair of successive bus bars, 10*a* and 10*b* are shown. The bus bars are preferably made of copper, with a cross sectional area corresponding to the maximum current loads for a given application, and having a length as desired according to the number of transverse slider rails desired in a given design.

Each bus bar is held by an insulating bus bar holder, as at 20*a* and 20*b* in FIG. 2. As explained with reference to bus bar holder 20*a*, each such holder has a flat side 21, for stacking against other members as explained hereinafter. The other side of holder 20 has a pair of grooves or slots, 22 and 23, which run longitudinally down the face of the holder. The upper slot 22 is sized to receive the bus bar 10, which fits snugly therein. As seen in FIG. 1, the thickness of the bus bar 10 is greater than the depth of the slot 22, so that a portion of the bus bar extends therefrom and is exposed as the contact surface 24. When the bars and insulating pieces are assembled into the stack as shown in FIG. 1, each contact surface of the bus bar is protected in an arc quenching chamber, between adjacent protruding tops of holders 20. The upper side portions of holders 20 are preferably rounded to assist in location of the slider contact as explained hereinafter.

Interlocking spacers 30 are provided as shown in FIGS. 1 and 2, to help secure the bus bar and the bus bar holders 20. As shown with reference to spacer 30*b*, each spacer is likewise an elongated member made of insulating material. In the preferred embodiment, interlocking spacers 30 do not run the full length of bus bars 10 or holders 20. Instead, spacers 30 are only long enough to accommodate the bus bar terminal connections and assembly clamping bolts are explained hereinafter. Sets of interlocking spacers 30 are provided at intervals along the length of bus bars 10 as may be required for assembly clamping purposes. In the preferred embodiment, sets of interlocking spacers 30 are provided at eight inch intervals, although it will be appreciated that the interlocking spacers could be coextensive in length to the bus bars if desired.

Each spacer 30 has one generally flat side 31 (the back side as oriented in FIG. 2), which butts against the flat side 21 of an adjacent bar holder 20. The upper portion of interlocking spacers 30 has a flat surface 32, and a vertically extending portion with a tongue member 33. As best seen in FIG. 1, the flat surface 32 of spacer 30 accepts the bottom surface of holders 20, while the tongue portion 33 fits into groove 23 in holders 20.

As seen in FIG. 2, at intervals wells 34, 35, and 36 are formed in the interlocking spacer 30, which temporarily interrupt surface 32 and tongue 33. These wells are for the purpose of facilitating electrical connection to the bus bars 10 by means of connecting terminals 40. Terminal 40 has a machined brass tap 41 protruding therefrom. Tap 41*a* projects up through the hole provided in the bottom of well 36*a* of spacer 30*a* and is tapped into bus bar 10*a* at 42, as indicated by the broken away portion of the drawing. By providing a plurality of wells, 34, 35 and 36, the terminal connections to adjacent bus bars can be staggered to provide necessary clearance between adjacent terminals. As seen in FIG. 1, the compact dimensions of the stack of bus bars and insulators as compared with the somewhat wider dimensions of terminal 40 would be such that either adjacent terminals would touch, or else the spacers would have to be made thicker thereby increasing the overall size of the cross connect panel, if it were not for the offsetting of the terminals. As seen in FIG. 2, terminals 40*a* would connect to bus bar 10*a* through wells 36*a*, while terminal 40*b* would connect to bus bar 10*b*, through well 35*b* and so on.

Clamping bolt holes 50 and 51 are provided in the lower portions of interlocking spacers 30, as seen in FIG. 2. It will be understood that bolt holes can be provided at intervals as desired for rigidity, according to the length of a particular design. Because the bolt holes pass below, rather than through the bus bars, there is no need to drill holes through the bus bars, nor provide any additional means of insulating the bus bars from the bolts. This is also seen in FIG. 1, where a clamping bolt 52 and nut 53 are shown in place holding the stack together.

In summary, the bus bars 10 are held in place by the interlocking system of the insulating bus bar holders and interlocking spacers. The groove 22 secures the bus bar with respect to up and down directions, and, in conjunction with the abutting surface of the adjacent holder, against side to side movements. The terminals 40 and taps 41 also serve to hold them secure against longitudinal movements. Finally, the clamping bolts which hold the entire assembly together are in a different plane than the bus bars, so that no drilling of clearance holes in the bus bars is required for the bolts. This in turn permits use of shorter bus bars (in the vertical sense) rather than the taller ones in the prior art which require a correspondingly greater amount of metal.

Referring again to FIG. 1, the bus bar stack is assembled between a pair of U-shaped frame members 60 and 61, by means of the same clamping bolt 52 and nut 53 which hold the bus bars and insulating spacers together. Additional side frame members 62 and 63 can be secured by bolts or any other suitable means to the outer edges of frame members 60 and 61. The side frame members are used for holding a row of circuit breakers 64, 65 on either side of the cross connect panel. A reinforcing bar or plate 66 extends across the width of the entire panel and is secured to side frame members 64 and 65 and U-shaped frame members 60 and 61 by any suitable means, for example by bolts as shown in FIG. 1. Reinforcing bar or plate 66 may be repeated at intervals along the length of the panel as may be required for the desired degree of rigidity. Finally, the entire cross connect panel can be secured to a rack or panel by means of attachments to the frame or side frame members, as may be desired.

A plurality of slide rail assemblies, one of which is shown in FIG. 1 and indicated generally by reference numeral 70, are provided, being mounted to the frame members and positioned transversely to the bus bar assembly. The construction of the slide rail assembly 70 according to the present invention is shown in greater detail in FIG. 3. In the preferred embodiment, each slide rail assembly has a pair of conductors 11*a*, 11*b*, although a separate assembly for each individual conductor could be provided if desired. However, greater efficiency is achieved in the embodiment shown. The conductors 11*a*, 11*b* are also electrical buses, in the same sense as bus bars 10. However, for clarity of explanation, the term "bus" will be used only in connection with bus bars 10, and the transverse conductors will be referred to as "rails". Rails 11*a* and 11*b* are held in place by abutment against lower surfaces 73 and 74 of rail support members 75 and 76. These rail support members may be made of a plastic insulating material. Each is provided with a lip or flange 77, 78 to locate the rails and keep them from slipping outwardly. A generally thin, flat insulating divider plate 80 is vertically oriented between rail support members 75, 76, and between rails 11*a* and 11*b*. A number of screws, 79, are provided at intervals as needed to hold 75, 80 and 76 together.

Figure 3:
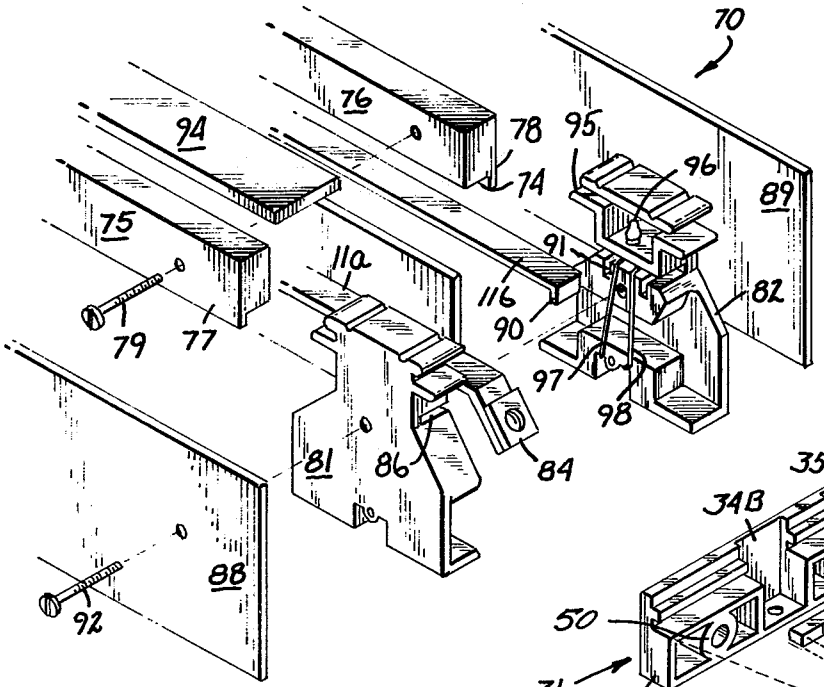
FIG. 3 is a fragmentary exploded perspective of a slide rail assembly for the panel of FIG. 1.

The rails are supported and located at their ends by mating end brackets 81 and 82, and by corresponding members at the other end not shown in FIG. 3. End member 81 has a horizontal slot 86 to receive and support the end extension of the rail 11*a*. The extreme end of rail 11*a* is bent downward at an angle, and a terminal connection 84 is soldered thereto. End bracket 81 has a sloping surface 83 against which terminal 84 is positioned. One end of the slot which positions rail 11*a* is visible in FIG. 3, and is indicated by reference numeral 86.

The other rail 116 does not have a terminal at the end shown in FIG. 3, but has its terminal, identical to terminal 84 of rail 11*a* at its other end (not shown in FIG. 3). The rails are arranged in this manner for the sake of compactness, due to the thickness of circuit breakers 64, 65. Thus alternate rails terminate on opposite sides of the panel. In FIG. 3, the end of rail 116 which is visible has a bent portion 90 at its end, which fits into a matching slot 91 in end bracket 82. The rails are thus secured by the end brackets 81 and 82, which fit together, with divider plate 80 between them. Cover plates 88*a* and 88*b* are also provided. Plate 88*a* is connected to the slide assembly of FIG. 3, and plate 88*b* is the corresponding cover plate on the adjacent slider assembly (not shown). Divider plate 80 and cover plate 88*a* extend the full length of the slider assembly, and are bolted to the end brackets by means of a bolt 92 which passes through cover plate 88, bracket 81, divider plate 80, and end bracket 82.

An indicia plate 94 may be made of transparent plastic such as plexiglass, and positioned on top of the upper surfaces of rail support members 75 and 76. The end of indicia plate 94 is captured by slots 95 in the end brackets. The indicia plate preferably has a number of suitable numbers engraved thereon, corresponding to the slide switch positions. In the preferred embodiment, a light bulb 96 is provided in a chamber molded into end bracket 82. A pair of conductors 97 and 98 extend downward through grooves in the bottom inside portion of end bracket 82. When the slide rail assembly 70 is positioned on the cross connect panel frame, the end of conductors 97 and 98 may contact conductive strips placed therealong, and fed from a suitable connect panel frame, the end of conductors 97 and 98 may contact conductive strips placed therealong, and fed from a suitable low voltage source to illuminate lamp 96. Lamp 96 then shines through the plexiglass indicia plate 94 to provide illumination of the reference indicia numbers engraved therein.

Referring now to FIG. 1, the installation of the slide rail assembly 70 on the cross connect panel frame is shown. Bolts 100 are provided at either end and secure the end brackets, and hence the entire assembly to the frame members 60, 61. Slide rail assembly 70 in FIG. 1 is partially broken away to illustrate the various components previously described with respect to FIG. 3.

Figure 4:
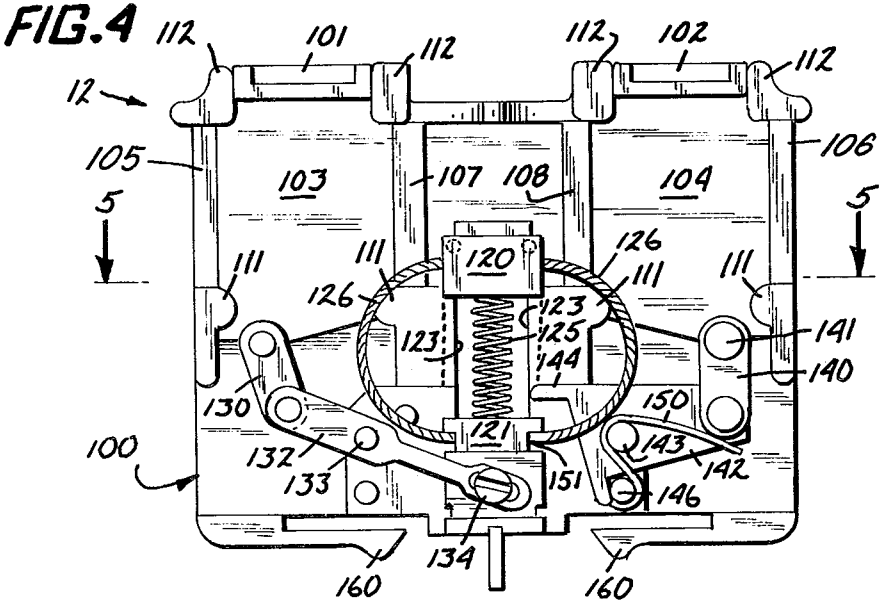
FIG. 4 is an elevational view of the cross connect slider of the panel of FIG. 1.
Figure 5:
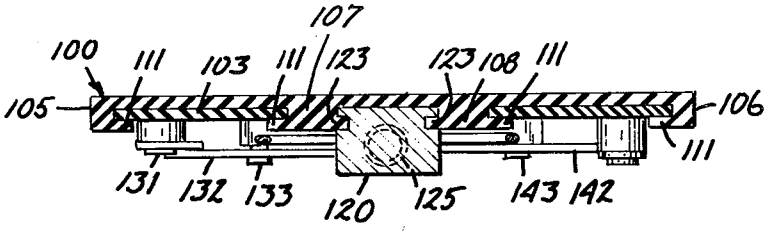
FIG. 5 is a sectional view taken generally along the line 5—5 of FIG. 4.

The cross connect panel slider assembly 12 is shown in greater detail in FIGS. 4 and 5. The slider comprises a frame member 100, to which all of the remaining components are attached. The frame 100 is generally planar in configuration, and contains a number of slots and mounting posts for securing the other operative parts. OFF and ON push buttons 101 and 102, respectively are provided. Each is connected to, or preferably formed integrally with a flattened slider portion 103, 104, respectively. As best seen in FIG. 5, slider 103 is positioned adjacent frame 100, and located by thickened or raised portions 105 and 107. Similarly, raised portions 106 and 108 locate slider 104. Overlying tabs 11 and bosses 112 confine sliders 103 and 104 adjacent frame 100.

A brush block 120 is provided near the center of frame 100. Directly beneath brush block 120 is the contactor block 121. These parts are preferably made of brass, and at the bottom of contactor block 121 is the contactor blade 122 which makes actual contact with the bus bars. As best seen in FIG. 5, brush block 120 has a pair of grooves formed therein, which mate with flanges 123 which are part of frame 100. Contact block 121 has similar grooves, and both blocks 120 and 121 are held adjacent frame 100, but are free to move up and down along the flanges. A spring 125 is mounted between blocks 120 and 121, for normally urging them apart. A pair of flexible braided wires 126 connect from block 120 to block 121 to insure good electrical conductivity therebetween. The braided wires may be secured by any suitable means, as by placing their ends in holes drilled in the blocks, then crimping the blocks to capture the ends of the wires. Spring 125 normally urges brush block 120 upwardly into contact with the rail, while at the same time urging contact block 121 downwardly into contact with a bus bar 10.

FIG. 4 shows the slider assembly in its ON position. A link 130 is pivotally connected to the post 131 integrally formed with slider 103. In the preferred embodiment, since the sliders may be made of plastic, the posts can be integrally formed therewith, and link 130 can be held in place by a cap glued to the top of the post, or by heating and flattening the top of the post, as is well known in the prior art. Another link 132 is pivotally connected to a post 133 connected to frame 100. The connection to post 133 acts as a fulcrum for link 132, one end of which is pivotally connected to link 130, and the other end of which connects by means of a elongated slot formed therein, to contact block 121, by means of a screw 134.

On the ON button side of the slider assembly, a link 140 is pivotally connected to a post 140 on slider 104. A latch member 142 is pivotally connected to link 141 at its one end, and is pivotally connected to the frame 100 at a post 143. At its other end, latch 142 has a finger 144. It also has a portion 145 which is designed to abut a stop member 146. A spring 150 has one end secured against stop 146, its central portion bent around fulcrum post 143, and its other end engaging a portion of latch 142 to normally urge it in a counterclockwise position as viewed in FIG. 4.

Figure 6:
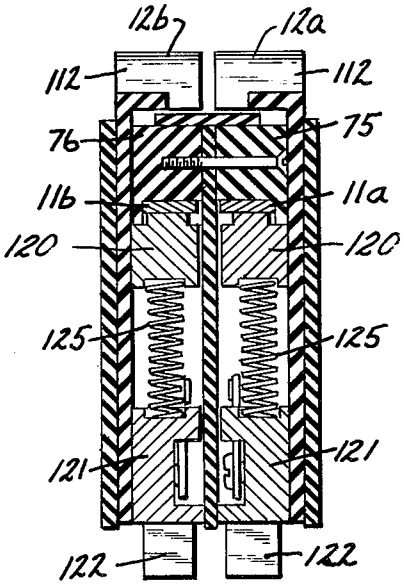
FIG. 6 is a sectional view taken generally along the line 6—6 of FIG. 1, portions thereof not shown.

FIG. 6 shows in sectional view the mounting of a pair of sliders 12, 12*a* and 12*b* for engagement of rails 11*a* and 11*b* respectively. Bosses 112 extend over the top of indicia plate 94, and the sliders are further held in place by cover plates 88 and 89, which confine the frame portion 100 of each slider between the cover plates and the rail support member 75, 76. Although constrained from coming off the slide rail assembly, the sliders are free to move therealong. In this position, contact blocks 120 are directly aligned with rails 11*a* and 11*b*.

When slider 12 is to be turned off, OFF button 101 is pushed downward, causing link 132 to pivot in a counterclockwise direction around point 133. This causes contact block 121, and of course the contact blade 122 to be forced upwardly along the guided slot between flanges 123. In its upward travel, the top of block 121 initially engages finger 144, tilting latch 142 in place in the ection, until finger 144 snaps intonotch 151 which is formed right behind the attachment point for the braided wire. In this position, contact block 121 is held up away from the bus bar because of the finger 144 of latch 142, and the portion 145 thereof which is in contact with stop member 146.

When it is desired to make contact between a bus rail and a bus bar, ON button 102 is pushed. This causes latch 142 to rotate clockwise, until finger 144 is free from notch 151. Spring 125 then drives block 121 downward, firmly engaging contact blade 122 with a bus bar.

Molded integrally with frame 100 are a pair of resilient detent members 160. Each of these members has a downward pointing projection at the end of a resilient arm. As best seen in FIG. 1, detent members 160 are positioned such that they snap into position in the contact channel above bus bars, and between the projecting tops of the bus bar holders, when the contact blade is directly over a bus bar. As the slider is moved from one position to another, the resilient detent members ride up and over the bus bar holders (which are rounded to assist in this movement) then snap back into position when the contact is aligned with a new bus bar. In this manner, the operator can easily tell by feel when the slider is moved to the proper position. The ON button is then pushed to allow the spring to drive the contact blade firmly into good electrical contact with the bus bar.

The switching means in the slider assembly according to the present invention thus prevents inadvertent unwanted contact with the bus bars as the slider is being moved from one position to another, and it prevents arcing and other poor connections by insuring that a good contact is made when the switch is put in the ON position.

I claim:

1. A cross connect panel, comprising:

(a) a plurality of elongated bus bars;

(b) means for supporting said bus bars in mutually insulated, spaced, parallel relationship;

(c) said supporting means comprising first insulating members having a groove on one side to receive a bus bar and a flat portion on the other side for abutting an adjacent bus bar, second insulating members positioned between adjacent first insulating members and beneath said bus bars in supporting relationship thereto, said first and second insulating members having complementary tongue and groove portions for interlocking together, and clamping means acting orthogonally to said insulating members to compress said bus bars in the grooves of said first members;

(d) a plurality of bus rails;

(e) means for supporting said bus rails in mutually spaced relationship substantially perpendicular to said bus bars and spaced therefrom; and (f) slider assemblies slideably positioned on said bus rails for movement therealong for selective alignment and contact with individual bus bars.

2. Apparatus according to claim 1 wherein said clamping means includes a clamping bolt passing through holes in said second insulating members generally orthogonally to said bus bars and spaced beneath the plane containing said bus bars.

3. Apparatus according to claim 1 further including bus bar terminals having threaded taps extending through holes in said second insulating members and threaded into said bus bars on a side thereof away from said bus rails, so as to further secure said bus bars to said insulating members.

4. A cross connect panel, comprising:

(a) a plurality of elongated bus bars;

(b) means for supporting said bus bars in mutually insulated spaced parallel relationship with adjacent bus bars separated by insulating members having rounded edges extending beyond said bus bars to form arc quenching chambers;

(c) a plurality of elongated bus rails;

(d) means for supporting said bus rails in mutually parallel spaced relationships substantially orthogonally to said bus bars and spaced thereabove;

(e) slider assemblies slideably positioned on said bus rails for movement therealong for selective alignment and contact with individual bus bars; and (f) said slider assemblies including a pair of contact blocks slideably positioned one above the other in each slider assembly for vertical movement therein, a spring positioned between said contact blocks for urging said contact blocks apart with the upper block electrically contacting the underside of a bus rail and the lower block being urged downwardly toward said bus bars, flexible conductor means electrically interconnecting said contact blocks, and operator actuatable retraction and release mechanisms operatively connected to said lower contact block for switchably controlling the connection and disconnection of conductive paths between said bus bars and said bus rails.

5. Apparatus according to claim 4, wherein said slider includes a pair of resilient index arms on the lower edge of each slider assembly on either side of said lower contact blocks and extending in a direction parallel to said bus rail, and a downwardly projecting detent formed in the end of each index arm and spaced from said lower contact block according to the spacing of said bus bars and quenching chambers, said resilient index arms and detents cooperating with said quenching chambers for positionally indexing said slider with respect to said bus bars.

* * * * *